US008480879B2

(12) United States Patent
Rosenbaum et al.

(10) Patent No.: US 8,480,879 B2
(45) Date of Patent: Jul. 9, 2013

(54) PROCESS FOR IMPROVING LUBRICATING QUALITIES OF LOWER QUALITY BASE OIL

(75) Inventors: John M. Rosenbaum, Richmond, CA (US); Brent K. Lok, San Francisco, CA (US); David C. Kramer, San Anselmo, CA (US); John O'Brien, Walton on Thames (GB); Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1083 days.

(21) Appl. No.: 12/047,887

(22) Filed: Mar. 13, 2008

(65) Prior Publication Data

US 2009/0233821 A1 Sep. 17, 2009

(51) Int. Cl.
*C10M 111/02* (2006.01)

(52) U.S. Cl.
USPC ..... 208/19; 208/18; 585/1

(58) Field of Classification Search
USPC ..... 208/18, 19; 585/1
See application file for complete search history.

(56) References Cited

U.S. PATENT DOCUMENTS

| | | | | |
|---|---|---|---|---|
| 4,737,301 | A * | 4/1988 | Bloch et al. | 508/301 |
| 6,806,237 | B2 * | 10/2004 | O'Rear | 508/110 |
| 6,833,484 | B2 * | 12/2004 | O'Rear | 585/1 |
| 7,053,254 | B2 | 5/2006 | Miller | |
| 7,144,497 | B2 | 12/2006 | Lok et al. | |
| 7,195,706 | B2 | 3/2007 | Abernathy et al. | |
| 7,273,834 | B2 | 9/2007 | Rosenbaum et al. | |
| 2005/0131112 | A1 * | 6/2005 | Henning et al. | 524/47 |
| 2005/0133409 | A1 * | 6/2005 | Abernathy et al. | 208/27 |
| 2006/0281643 | A1 * | 12/2006 | Habeeb et al. | 508/192 |
| 2007/0142240 | A1 | 6/2007 | Loh et al. | |
| 2007/0142250 | A1 | 6/2007 | Loh et al. | |
| 2009/0111936 | A1 * | 4/2009 | Wedlock | 524/551 |

FOREIGN PATENT DOCUMENTS

WO WO 2007003623 A1 * 1/2007

OTHER PUBLICATIONS

"Lubricant Base Oil and Wax Processing", Avilino Sequeira, Jr., Marcel Dekker, Inc. NY 1994 ISBN0-8247-9256-4 pp. 53-80 and 170.*

U.S. Appl. No. 11/613,936, Rosenbaum, John M., "A Light Base Oil Fraction and Lubricant Having Low WT% NOACK Volatility", Jun. 25, 2010.

U.S. Appl. No. 11/613,883, Rosenbaum, John M., "Lubricant Base Oil Blend Having Low WT% NOACK Volatility", Apr. 25, 2011.

* cited by examiner

*Primary Examiner* — Pamela H Weiss

(74) *Attorney, Agent, or Firm* — Jeffrey McQuiston; Penny Prater

(57) ABSTRACT

A process for producing an API Group I base oil, comprising: blending a lower quality base oil that does not meet API Group I specifications with a Fischer-Tropsch derived distillate fraction having defined pour point, viscosity index and Oxidator B, and isolating an API Group I base oil that has improved defined properties. A process for producing an API Group I base oil, consisting essentially of: (a) selecting a lower quality base oil not meeting API Group I specifications, having defined saturates, viscosity index and Oxidator BN; and (b) blending the lower quality base oil with a Group II base oil and a Fischer-Tropsch derived base oil. A process for improving the lubricating properties of a lower quality base oil. Also, a process for operating a base oil plant.

39 Claims, 1 Drawing Sheet

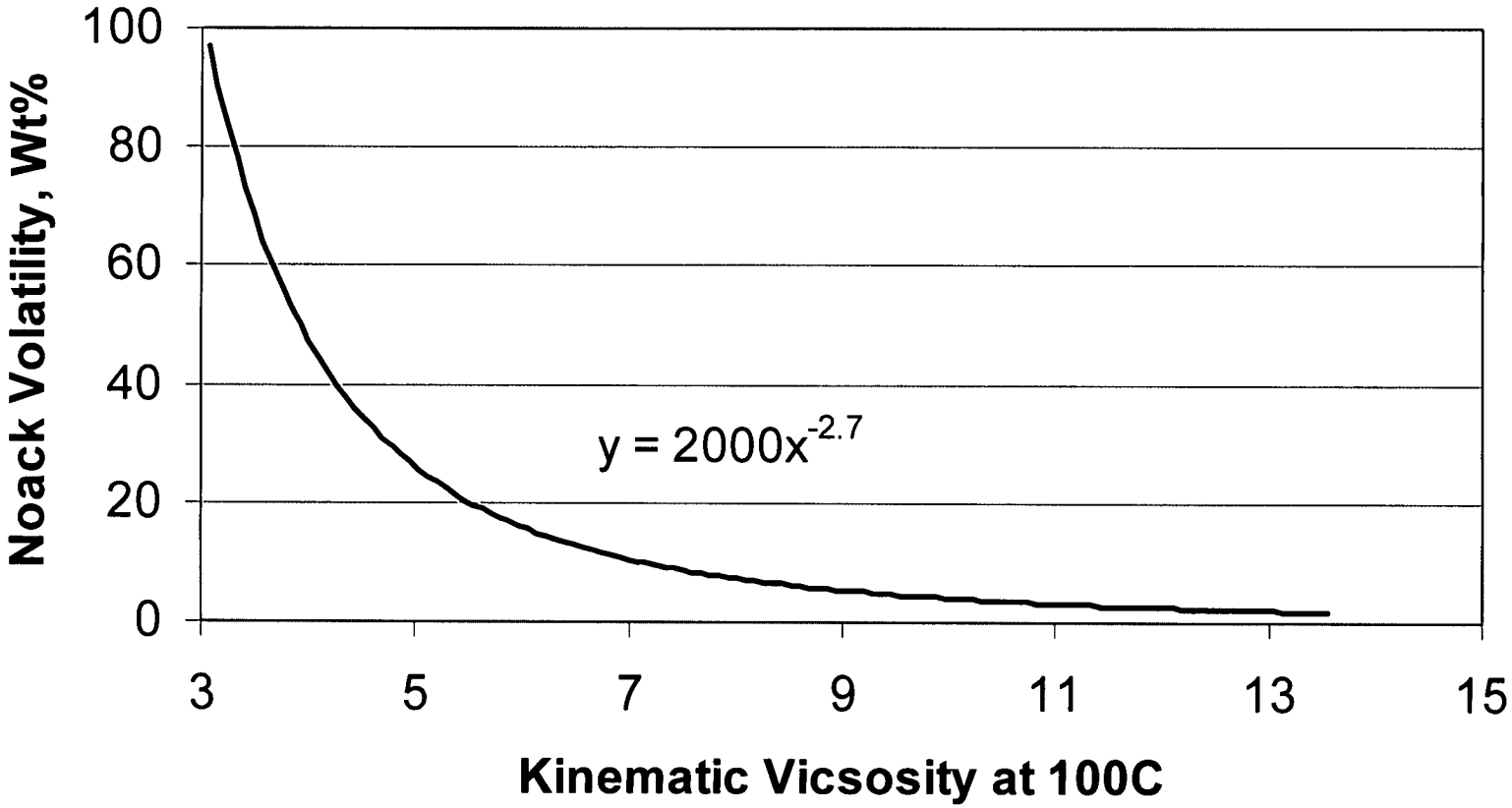
Noack Volatility, Wt%
100
80
60
40
20
0
3
5
7
9
11
13
15
Kinematic Vicsosity at 100C
y = 2000x^-2.7

PROCESS FOR IMPROVING LUBRICATING QUALITIES OF LOWER QUALITY BASE OIL

FIELD OF THE INVENTION

This invention is directed to processes for producing an API Group I base oil, a process for improving the lubricating properties of a lower quality base oil, and a process for operating a base oil plant.

BACKGROUND OF THE INVENTION

Improved processes for producing API Group I base oil by blending lower quality base oil that may not even meet API Group I specifications with a second base oil are needed. There would be cost advantages and performance advantages achieved by being able to produce and utilize lower quality base oils that could be blended to meet specifications.

SUMMARY OF THE INVENTION

There is provided a process for producing an API Group I base oil, comprising:

a. obtaining a lower quality base oil not meeting API Group I specifications, having,
   i. a saturates level less: than 90 weight percent, and
   ii. one or more suboptimal properties selected from the group consisting of a viscosity index less than 80, a pour point greater than −10 degrees C. and an Oxidator BN of less than 15 hours; and b. blending the lower quality base oil with a Fischer-Tropsch derived distillate fraction having:
   i. a Fischer-Tropsch pour point less than −9 degrees C.;
   ii. a Fischer-Tropsch viscosity index greater than an amount calculated by the equation: 28×Ln(Kinematic Viscosity at 100° C.)+80;
   iii. a Fischer-Tropsch Oxidator BN of greater than 20 hours, and c. isolating the API Group I base oil;

wherein the API Group I base oil has a viscosity index greater than 95, a pour point less than −7 degrees C., and an Oxidator BN of greater than 9.5 hours.

There is provided a process for improving the lubricating properties of a lower quality base oil not meeting API Group I specifications, that is characterized by:

a. a saturates level less than 70 weight percent.

b. a viscosity index less than 70, and c. an Oxidator RN of less than 6 hours;

the process comprising: blending with said lower quality base oil a Fischer-Tropsch derived distillate fraction; wherein an API Group I base oil is produced.

There is provided a process for producing an API Group I base oil, consisting essentially of: (a) selecting a lower quality base oil not meeting API Group I specifications, that is characterized by a saturates level less than 70 weight percent, a viscosity index less than 70, and an Oxidator BIN of less than 6 hours; and (b) blending the lower quality base oil with a Group II base oil and a Fischer-Tropsch derived base oil to make an API Group I base oil.

There is also provided a process for operating a base oil plant, comprising:

a. selecting a refinery operating condition to produce a lower quality base oil not meeting API Group I specifications, that is characterized by:
   i. a saturates level less than 70 weight percent,
   ii. a viscosity index less than 70, and
   iii. an Oxidator BN of less than 6 hours;

b. blending the lower quality base oil with a second base oil to make a blended base oil meeting API Group I specifications.

BRIEF DESCRIPTION OF THE DRAWING

FIG. 1 illustrates the plot of Kinematic Viscosity at 100° C., in $mm^2/s$, versus Noack Volatility, in wt %; providing the plot of the equation:

$$2000\times(\text{Kinematic Viscosity})^{-2.7},$$

DETAILED DESCRIPTION OF THE INVENTION

The specifications for Lubricating Base Oils are defined in the API Interchange Guidelines (API Publication 1509).

| API Group | Sulfur, ppm | | Saturates, % | VI |
|---|---|---|---|---|
| I | >300 | And/or | <90 | 80-120 |
| II | ≦300 | And | ≧90 | 80-120 |
| III | ≦300 | And | ≧90 | >120 |
| IV | All Polyalphaolefins (PAOs) | | | |
| V | All Base Oils Not Included in API Groups I-IV | | | |

API Group I base oils are desired in certain finished lubricant formulations as there are specialized additive packages and individual additives that are designed for use in these base oils, and improving one or more properties, such as VI, sulfur or saturates level by blending can enable the resulting blended base oil to be used in lubricant formulations unattainable by either blend component.

In general, the properties most desired in base oils, however, are high viscosity index, low sulfur, low pour point, and high saturates content. Achieving the more desired properties can be costly, complicated, and require significant energy expenditure to produce. We have found that lower quality base oil, not even meeting API Group I specifications, can be produced efficiently and then blended with a second base oil to be brought up to API Group I specifications.

The lower quality base oil can be bio-derived, petroleum derived, synthetic, or mixtures thereof. The lower quality base oil will have a low saturates content. For example it can have less than 90 weight percent, less than 70 weight percent, less than 60 weight percent, or even less than 50 weight percent. Saturates, at levels of less than about 95 wt %, are measured by fluorescence indicator adsorption (FIA). The standard method used in the petroleum industry for measuring the quantitative amount of saturates, olefins and aromatics in a hydrocarbon composition is discussed in "Hydrocarbon Types in Liquid Petroleum Products by fluorescence. Indicator Absorption", ASTM Test No. D 1319-03, updated editorially in June 2006.

The lower quality base oil has one or more other suboptimal properties, which can include low viscosity index, high pour point, and low oxidation stability. Viscosity index (VI) is an empirical, unitless number indicating the effect of temperature change on the kinematic viscosity of the oil. The lower quality base oil can have a viscosity index less than 100 or less than 90, such as less than 70, less than 60, or even less than 50. The viscosity index in some embodiments can be even less than 0. The test method used to measure viscosity index is ASTM D 2270-04. The lower quality base oil can have a pour point that is higher than desired, for example greater than −15° C., greater than −10, or greater than 0° C. Pour point is a measurement of the temperature at which a sample of base oil will begin to flow under carefully controlled conditions. One test method used to measure pour point is D 5950-02 (Reapproved 2007).

The lower quality base oil can have a low oxidation stability, as determined by measuring the Oxidator BN. The Oxidator BN can be less than 20 hours, less than 15 hours, less than 6 hours, less than 4 hours, or even less than 2 hours. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper 6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application, High values, or long times to absorb one liter of oxygen, indicate good oxidation stability.

OLOA is an acronym for Oronite Lubricating Oil Additives®, which is a registered trademark of Chevron Oronite.

The lower quality base oil can be produced in a base oil plant under refinery operating conditions that contribute to the properties of the base oil. The most common refining process that can be used for waxy feeds is solvent dewaxing.

Solvent dewaxing is a process often employed in the production of API Group I base oils. Solvent dewaxing employs a dewaxing solvent which assists in the separation of wax from the oil. The solvents employed mix readily with the oil to form a solution but have the effect of decreasing the solubility of the wax in the oil solvent mixture so that the wax will crystallize out of the oil at a higher temperature. This, in turn, means that oils of lower pour point can be more readily produced with only a moderate degree of cooling in the process since the pour point of the dewaxed oil is dependent both upon the solubility of the wax in the oil and the temperature at which the dewaxing is performed. Thus, a reduction in the solubility of the wax means either that lower pour point oils may be produced at given operating temperatures or that a given pour point obtained at higher operating temperatures. Generally, ketones will be used for this purpose, with acetone, methyl ethyl ketone (MEK), methyl propyl ketones, methyl butyl ketones especially methyl iso-butyl ketone, being frequently selected.

The ketone may be used by itself or, more preferably, with an aromatic solvent such as benzene, toluene or petroleum naphtha which increases the solubility of the oil but diminishes the solubility of the wax. The amount of solvent used will be dependent upon other factors such as the pour point desired for the dewaxed product, the wax content of the feedstock (amount and type of wax), viscosity of the dewaxed oil, the design operating temperature of the system and the amount, if any, of autorefrigerant used.

In one embodiment of solvent dewaxing there is a chilling zone, where wax is precipitated from the oil to form a waxy slurry and the so formed slurry is further chilled down to the wax filtration temperature by stage-wise contact with a liquified gas such as propylene, or other auto-refrigerant, which is injected into the liquid layer. An autorefrigerant, as used herein, is equivalent to a liquefied gas. Autorefrigeration is a three step process comprised in its most basic form of (a) condensing gases by cooling, (b) separating out the liquefied gases, and (c) evaporating the liquefied gases to provide cooling. The presence of other compounds within the liquefied gases such as dissolved gases (e.g., hydrogen), or the presence of an added substance such as methanol to lower the freezing point, or the use of an intermediary stream to transfer heat from the condensing stream to the evaporating stream do not alter the fundamental fact that an autorefrigeration stage exists if the three basic steps (a), (b) and (c) are present. Those three steps can be present two or more times (i.e. two or more stages). An autorefrigeration stage is characterized by a temperature range at which condensation of gases takes place at the pressure at which evaporation of the liquefied acid gases takes place.

The amount of solvent used in solvent dewaxing may be determined by appropriate experience or experiment but as a general guide will be from 0.5:1 to 4:1 (solvent oil) based on the weight of the oil feed. Refining costs may be reduced and safety is improved with lower solvent:oil ratios of 0.5:1 to 2:1. As the lower quality base oil can have a higher pour point, there is more flexibility in selecting the choice of solvents and the solvent:oil ratio.

In the past the choice of solvents was restricted to those that were less sulfur-selective or to those that had lower solubility of the wax in the oil-solvent mixture. The restricted choices of solvents were necessary so that the amount: of sulfur in the separated oil was kept at a lower level and the pour point was acceptably low. The choice of solvents can now be expanded and selected for other features such as low cost, environmental benefits, energy savings, or safety.

Solvents may be selected having different sulfur solubility. One method for measuring the sulfur solubility of a solvents is by the following method. 10 mg of sulfur powder is added to each solvent and agitated for 10 minutes. If the sulfur powder dissolves completely, then an additional 10 mg of sulfur powder is added, and this procedure is conducted repeatedly. When a portion of added sulfur powder does not dissolve, the non-dissolved sulfur is recovered through filtration with a filter paper, and the mass of the filtered sulfur is measured. The sulfur solubility of the solvent is calculated from the mass of the non-dissolved sulfur. The sulfur solubilities of some example tested solvents are shown below in Table 1.

TABLE 1

| No. | Solvent | Non-dissolved sulfur (mg) | Sulfur solubility (mM) |
|---|---|---|---|
| 1 | Benzene | 900 | 87.9 |
| 2 | Fluorobenzene | 850 | 83.0 |
| 3 | Toluene | 860 | 84.0 |
| 4 | Trifluorotoluene | 800 | 78.1 |
| 5 | Xylene | 790 | 77.1 |
| 6 | Cyclohexane | 950 | 92.8 |
| 7 | Tetrahydrofurane (THF) | 490 | 47.9 |
| 8 | 2-methyl tetrahydrofurane (2-MeTHF) | 450 | 43.9 |
| 9 | Cyclohexanone | 80 | 7.8 |
| 10 | Ethanol (EtOH) | 9 | 0.9 |
| 11 | Isopropanol | 10 | 1.0 |
| 12 | Dimethyl carbonate (DMC) | 8 | 0.8 |

As shown in Table 1, a solvent having a sulfur solubility greater than or equal to 50 mM, for example, would include cyclohexane, xylene, trifluorotoluene, toluene, fluorobenzene, and benzene.

Second Base Oil

The lower quality base oil is blended with a second, much higher quality, base oil. The second base oil can have a very high viscosity index. It can also have a lower kinematic viscosity than the lower quality base oil that it is blended with. Kinematic viscosity is a measurement of the resistance to flow of a fluid under gravity. Many base oils, finished lubricants made from them, and the correct operation of equipment depends upon the appropriate viscosity of the fluid being used, Kinematic viscosity is measured by ASTM D 445-06.

In some embodiments the second base oil will be Fischer-Tropsch derived. "FischerTropsch derived" means that the material originates from or is produced at some stage by a Fischer-Tropsch synthesis process which produces Fischer-Tropsch synthesis products. The Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, EP-A-776959 EP-A-668342; U.S. Pat. Nos. 4,943,672, 5,059,299, 5,733,839, and RE39073; and US Published Application No. 2005/0227866, WO-A-9934917, WO-A-9920720 and WO-A-05107935, The Fischer-Tropsch synthesis product usually comprises hydrocarbons having 1 to 100, or even more than 100 carbon atoms, and typically includes paraffins, olefins and oxygenated products. Fischer Tropsch is a viable process to generate clean alternative hydrocarbon products.

Fischer-Tropsch derived base oils are described for example in US20040256287, US20040256286, US20040159582, US701825, US 20050139513. U.S. Pat. No. 7,282,134, US200600016724, U.S. Pat. No. 6,700,027, U.S. Pat. No. 6,702,937, U.S. Pat. No. 6,605,206, US20060289337, and US20060201851. The processes used to make these base oils can include hydrocracking, hydroisomerizing, oligomerizing, catalytic and/or solvent dewaxing, separating, vacuum distilling, and hydrofinishing.

The Fischer-Tropsch derived base oil can have a viscosity index greater than an amount calculated by the equation: 28×Ln(Kinematic Viscosity at 100° C.)+80. In some embodiments, it will have a viscosity index greater than an amount calculated by the equation: 28×Ln(Kinematic Viscosity at 100° C.)+90, or greater than an amount calculated by the equation: 280×Ln(Kinematic Viscosity at 100° C.)+95.

The second base oil has good oxidation stability. In some embodiments it can have an Oxidator BN greater than 15 hours, greater than 20 hours, greater than 25 hours, or greater than 35 hours. The Oxidator BN of the second base oil will typically be less than about 75 hours.

The second base oil can be one of several different grades. Base oils recovered from a vacuum distillation tower can include a range of base oil grades, such as XXLN, XLN, LN, MN, and HN. An XXLN grade of base oil when referred to in this disclosure is a base oil having a kinematic viscosity at 100° C. between about 1.5 $mm^2/s$ and about 2.3 $mm^2/s$. An XLN grade of base oil will have a kinematic viscosity at 100° C. between about 2.3 $mm^2/s$ and about 3.5 $mm^2/s$. A LN grade of base oil will have a kinematic viscosity at 100° C. between about 3.5 $mm^2/s$ and about 5.5 $mm^2/s$. A MN grade of base oil will have a kinematic viscosity at 10000 between about 5.5 $mm^2/s$ and 10 $mm^2/s$. A HN grade of base oil will have a kinematic viscosity at 100° C. above 10 $mm^2/s$. Generally, the kinematic viscosity of a Ht grade of base oil at 100° C. will be between about 10.0 $mm^2/s$ and about 30.0 $mm^2/s$ or between about 15.0 $mm^2/s$ and about 30.0 $mm^2/s$.

Base oils produced by hydroprocessing tend to produce higher amounts of lower viscosity products, due to hydrocracking of heavier molecules in the feed to the process. These oils can be of very high quality, but: the base oil grades of XXLN, XLN, and LN will be produced in higher yields than the MN and HN grades. In one embodiment the lower quality base oil is a MN or HN grade and the second base oil is a XXLN, XLN, or LN grade.

In one embodiment, the second base oil is a Fischer-Tropsch derived distillate fraction having between 90 and 99 wt % paraffinic carbon and between 2 and 10 wt % naphthenic carbon, Paraffinic carbon and naphthenic carbon are determined by n-d-M analysis (ASTM D 3238-95 (Re-approved 2005)).

Molecular characterizations can be performed by methods known in the art, including Field Ionization Mass Spectroscopy (FIMS). In FIMS, the base oil is characterized as alkanes and molecules with different numbers of unsaturations. The molecules with different numbers of unsaturations may be comprised of cycloparaffins, olefins, and aromatics. If aromatics are present in significant amount: they would be identified as 4-unsaturations. When olefins are present in significant amounts, they would be identified as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality. If the aromatics content was not measured, it was assumed to be less than 0.1 wt % and not included in the calculation for total weight percent of molecules with cycloparaffinic functionality. The total weight percent of molecules with cycloparaffinic functionality is the sum of the weight percent of molecules with monocyclopraffinic functionality and the weight percent of molecules with multicycloparaffinic functionality.

Molecules with cycloparaffinic functionality mean any molecule that is, or contains as one or more substituents, a monocyclic or a fused multicyclic saturated hydrocarbon group. The cycloparaffinic group can be optionally substituted with one or more, such as one to three, substituents. Representative examples include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group can be optionally substituted with one or more, such as one to three, substituents. Representative examples include, but are not limited to, cyclopropyl, cyclobutyl, cyclohexyl cyclopentyl, cloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group often is of two fused rings. The cycloparaffinic group can be optionally substituted with one or more, such as one to three, substituents. Representative examples include, but are not limited to decahydronaphthalene, octahydropentalene, 3,7,10-tricyclohexylpentadecane, decahydro-1-(pentadecan-6-yl) naphthalene, and the like.

In one embodiment the second base oil is a Fischer-Tropsch derived distillate fraction having greater than 10 wt % total molecules with cycloparaffinic functionality and a high ratio of molecules with monocycloparaffinic functionality to molecules with multicycloparaffinic functionality. The ratio of cycloparaffins can be greater than 3, greater than 5, greater than 10, greater than 15, or greater than 20. Processes to produce these types of base oils are taught in U.S. Pat. No. 7,282,134 and US20060289337. The processes include dewaxing a Fischer-Tropsch wax under selected conditions using a shape selective medium pore catalyst.

Lubricant Base Oil Blend

The blending of the lower quality base oil with a second base oil produces an API Group I base oil. The API Group I base oil comprises at least 5 wt %, such as at least 10 wt %, based on the total composition of the lower quality base oil. The API Group I base oil comprises less than 90 wt % of the lower quality base oil. The API Group I base oil comprises between 5 and 80 wt %, such as between 10 and 50 wt % or between 20 and 40 wt %, of the second base oil.

The API Group I base oil can be of excellent quality, including having a high viscosity index, low pour point, and excellent oxidation stability, Additionally it can have a low CCS viscosity or a low Noack volatility. The API Group I base oil can have a viscosity index greater than 95, such as greater than 100, or even greater than 105. The API Group i base oil can have a pour point less than −5° C., such as less than −7° C., less than −10° C., less than −15° C., or even less than −20° C. The API Group I base oil can have an Oxidator BN greater than 8 hours, for example greater than 9.5, greater than 11, or greater than 12 hours.

In one embodiment the API Group I base oil has a low CCS Viscosity. It can be a LN grade with a CCS Viscosity at −25° C. of less than 4,000 cP. It can be a MN grade with a CCS Viscosity at −20° C. of less than 4,000 cP, or it can be a HN grade with a CCS Viscosity at −10° C. of less than 4,000 cP. CCS Viscosity is a test used to measure the viscometric properties of oils under low temperature and high shear. A low CCS Viscosity makes an oil very useful in a number of finished lubricants, including multigrade engine oils. The test method to determine CCS Viscosity is ASTM D 5293-04. Results are reported in centipoise, cP.

In one embodiment the API Group I base oil has a now Noack volatility Noack volatility is usually tested according to ASTM D5800-05 Procedure B. Noack volatility of base oils generally increases as the kinematic viscosity decreases. The lower the Noack Volatility, the lower the tendency of base oil and formulated oils to volatilize in service. The API Group I base oil can have a Noack volatility less than an amount calculated by the equation: 2000×(Kinematic Viscosity at 100°)$^{-2.7}$.

Finished Lubricants:

Finished lubricants comprise a lubricant base oil and at least one additive. The lubricant base oil can be the Group I base oil, Lubricant base oils are the most important component of finished lubricants generally comprising greater than 70% of the finished lubricants. Finished: lubricants may be used for example, in automobiles, diesel engines, axles, transmissions, and industrial applications. Finished lubricants must meet the specifications for their intended application as defined by the concerned governing organization.

Additives which may be blended with the lubricant base oil blend to provide a finished lubricant composition include those which are intended to improve select properties of the finished lubricants. Typical additives include, for example, pour point depressants, anti-wear additives, EP agents, detergents, dispersants, antioxidants, viscosity index improvers, viscosity modifiers, friction modifiers, demulsifiers, antifoaming agents, corrosion inhibitors, rust inhibitors, seal swell agents, emulsifiers, wetting agents, lubricity improvers, metal deactivators, gelling agents, tackiness agents, bactericides, fungicides, fluid-loss additives, colorants, and the like.

Typically, the total amount of additives in the finished lubricant will be approximately 0.1 to about 30 weight percent of the finished lubricant. However, since the lubricating base oils of the present invention have excellent properties including excellent oxidation stability, low wear, high viscosity index, low volatility, good low temperature properties, good additive solubility, and good elastomer compatibility, a lower amount of additives may be required to meet the specifications for the finished lubricant than is typically required with base oils made by other processes. The use of additives in formulating finished lubricants is well documented in the literature and well known to those of skill in the art.

EXAMPLES

Example 1

Two samples of base oils not meeting API group I specifications had the properties as shown in Table I.

TABLE I

| | Ergon H2000 | Ergon Hygold 100 |
|---|---|---|
| | Base Oil Grade | |
| | HN | XLN |
| Kinematic Viscosity @ 100° C., mm2/s | 16.94 | 3.436 |
| Kinematic Viscosity @ 40° C., mm$^2$/s | 389.3 | 19.80 |
| Viscosity Index | −11 | −7 |
| Pour Point, ° C. | −14 | −45 |
| Aromatics, wt. % | 50.7 | 33.3 |
| Saturates, wt % | <49.3 | <66.7 |
| Sulfur, ppm | 2080 | 291 |
| Oxidator BN, Hours | 1.94 | 1.97 |

Three samples of Fischer-Tropsch derived base oils were made by hydroisomerizing a hydrotreated Fischer-Tropsch wax, followed by hydrofinishing and fractionation. All three of these samples were distillate fractions. As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column. The properties of the three FischerTropsch derived base oils are summarized in Table II.

TABLE II

| | XLFTBO | LFTBO | MFTBO |
|---|---|---|---|
| | Base Oil Grade | | |
| | XLN | LN | MN |
| Kinematic Viscosity @ 100° C., mm$^2$/s | 2.926 | 4.081 | 7.929 |
| Kinematic Viscosity @ 40° C., mm$^2$/s | 10.85 | 16.93 | 42.30 |
| Viscosity Index | 124 | 147 | 162 |
| Pour Point, ° C. | −37 | −25 | −22 |
| Aromatics, wt. % | 0.013 | 0.0229 | 0.0005 |
| Sulfur, ppm | 0 | 0 | 0 |
| Oxidator BN, Hours | 40.16 | 37.50 | 45.86 |

TABLE II-continued

| | XLFTBO | LFTBO | MFTBO |
|---|---|---|---|
| | Base Oil Grade | | |
| | XLN | LN | MN |
| Total Wt % Cycloparaffins | 30.0 | 19.1 | 30.0 |
| Mono-cycloparaffins/Multi-cycloparaffins | 4.4 | 12.6 | 13.3 |
| n-d-M | | | |
| Wt % Paraffinic Carbon | 95.42 | 95.76 | 93.68 |
| Wt % Naphthenic Carbon | 4.58 | 4.24 | 6.32 |
| Wt % Aromatic Carbon | 0.00 | 0.00 | 0.00 |
| Saturates, wt % | 99.99 | 99.98 | >99.99 |
| Noack, wt. % | 32.37 | 18.28 | 2.02 |
| TBP 10% Boiling Point | 692 | 739 | 884 |

The very high saturates were measured more accurately by high pressure liquid chromatography (HPLC). The sample is dissolved in n-hexane and any insolubles are removed by filtration, dried, and weighed. The filtrate is concentrated to a known volume, a portion is quantitatively injected into the HPLC, and the separation is monitored with a refractive index (RI) detector. The saturates are eluted with n-hexane and collected. The flow of n-hexane is reversed and the aromatics are eluted and collected. When the aromatics are completely eluted, as indicated by the RI detector, the mobile phase is changed to a 1:1 mixture of acetone and methylene chloride and the polars are then eluted and collected. The solvents are evaporated, the fractions are weighed and the weight percent distribution in the original sample is calculated. The fractions may be used for further analyses (MS, GC, NMR, etc.).

Note that all three of these FischerTropsch base oils had very high viscosity indexes, generally such that X, in the equation VI=28×Ln(Kinematic Viscosity at 100° C.)+X, is greater than 90. The LFTBO and MFTBO had values of X that are especially desired, greater than 107 and greater than 104 respectively.

Example 2

The petroleum derived base oils not meeting API Group I specifications were blended with the Fischer-Tropsch derived base oils of Example I in different proportions to produce LN, MN, and HN grade API Group I base oils having improved properties. The blend compositions and properties are summarized in Table III.

TABLE III

| | Base Oil Grade | | | |
|---|---|---|---|---|
| | LN | MN | | HN |
| | Sample ID | | | |
| | "110N" | "220N" | "230N" | "575N" |
| Wt % Components in Blends | | | | |
| Chevron 220R | 42 | 65 | 67 | |
| Chevron 600R | | | | 65 |
| Ergon H2000 | | 14 | 14 | 14 |
| Ergon Hygold 100 | 23 | | | |
| XLFTBO | 35 | 21 | | |
| LFTBO | | | 19 | |
| MFTBO | | | | 21 |
| Total | 100 | 100 | 100 | 100 |
| Kinematic Viscosity @ 100° C., $mm^2/s$ | 4.067 | 5.689 | 6.130 | 11.05 |
| Kinematic Viscosity @ 40° C., $mm^2/s$ | 19.80 | 34.14 | 68.02 | 91.0 |
| Viscosity Index | 104 | 106 | 107 | 107 |
| Cold Crank Viscosity @ −25° C., cP | 1,259 | | | |
| Cold Crank Viscosity @ −20° C., cP | | 2,072 | 2,457 | |
| Cold Crank Viscosity @ −10° C., cP | | | | 3,231 |
| Pour Point, ° C. | −23 | −18 | −18 | −19 |
| Oxidator BN, hrs. | 9.9 | 11.2 | 11.4 | 12.6 |
| S, ppm | 74.9 | 306.3 | 303.1 | 310.7 |
| Aromatics, wt. % | 9.69 | 5.51 | 6.55 | 8.80 |
| Noack, wt. % loss | 40.56 | 13.54 | 10.66 | 2.5 |
| Simulated Distillation, ° F. | | | | |
| 0.5 | 532 | 647 | 643 | 718 |
| 5 | 602 | 688 | 708 | 804 |
| 10 | 645 | 707 | 736 | 837 |
| 20 | 690 | 737 | 765 | 876 |
| 30 | 712 | 759 | 788 | 901 |
| 40 | 730 | 781 | 809 | 921 |
| 50 | 749 | 806 | 828 | 938 |
| 60 | 768 | 830 | 848 | 955 |
| 70 | 794 | 855 | 868 | 974 |
| 80 | 837 | 882 | 891 | 995 |
| 90 | 886 | 917 | 923 | 1022 |
| 95 | 920 | 942 | 948 | 1045 |
| 99.5 | 988 | 999 | 1006 | 1099 |

Note that these blends were all API Group I base oils having viscosity indexes greater than 95, pour points less than −7 degrees C, and Oxidator BNs greater than 9.5 hours, All three blends had a Noack Volatility less than an amount calculated by the equation: 2000×(Kinematic Viscosity at 100° C.)$^{-2.7}$. The plot of this equation is shown in FIG. 1. The LN grade "110N" example had an especially low CCS Viscosity at −20° C., of less than 4,000 CP. The MN grade "220N" and "230N" examples had excellent CCS: Viscosities at −20° C. of less than 4,000 cP; and the HN "575N" example also had an excellent CCS Viscosity at −10° C. of less than 4,000 cP. These would be excellent base oils for blending into a broad variety of finished lubricants.

All three of these blends were examples of a process for producing an API Group I base oil consisting essentially of or consisting of: a) selecting a lower quality base oil not meeting API Group I specifications, that is characterized by a saturates level less than 70 weight percent, a viscosity index less than 70, and an Oxidator BN of less than 6 hours, b) blending the lower quality base oil with a Group II base oil and a Fischer-Tropsch derived base oil to make an API Group I base oil.

Example 3

Blends of the petroleum derived base oils not meeting API Group I specifications were blended, for comparison, with conventional petroleum derived Chevron API Group II base oils in different proportions to produce LN, MN, and HN grade API Group I base oils having improved properties.

TABLE IV

| | Base Oil Grade | | |
|---|---|---|---|
| | LN "160N" | MN "300N" | HN "725N" |
| Wt % Components in Blends | | | |
| Chevron 220R | 65 | 82 | |
| Chevron 600R | | | 82 |
| Ergon H2000 | | 18 | 18 |
| Ergon Hygold 100 | 35 | | |
| XLFTBO | | | |
| LFTBO | | | |
| MFTBO | | | |
| Total | 100 | 100 | 100 |
| Kinematic Viscosity @ 100° C., $mm^2/s$ | 5.188 | 7.241 | 12.63 |
| Kinematic Viscosity @ 40° C., $mm^2/s$ | 31.90 | 53.39 | 125.7 |
| Viscosity Index | 88 | 93 | 91 |
| Cold Crank Viscosity @ −25° C., cP | 5,090 | | |
| Cold Crank Viscosity @ −20° C., cP | | 5,847 | |
| Cold Crank Viscosity @ −10° C., cP | | | 6,626 |
| Pour Point, ° C. | −20 | −17 | −19 |
| Oxidator BN, hrs. | 5.7 | 9.4 | 9.6 |
| S, ppm | 115.4 | 392.1 | 397.1 |
| Aromatics, wt. % | 14.60 | 8.82 | 10.80 |
| Noack, wt. % loss | 30.23 | 10.25 | 2.57 |
| Simulated Distillation, ° F. | | | |
| 0.5 | 520 | 644 | 706 |
| 5 | 584 | 704 | 792 |
| 10 | 617 | 736 | 823 |
| 20 | 667 | 770 | 863 |
| 30 | 708 | 795 | 890 |
| 40 | 745 | 815 | 913 |
| 50 | 779 | 835 | 933 |
| 60 | 809 | 854 | 951 |
| 70 | 839 | 875 | 973 |
| 80 | 871 | 899 | 995 |
| 90 | 910 | 931 | 1025 |
| 95 | 938 | 956 | 1051 |
| 99.5 | 1000 | 1012 | 1109 |

These comparison blends died not have the high Vi and high Oxidator BN of the API Group I base oils of our invention.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A process for producing an API Group I base oil, comprising:

a. obtaining a lower quality base oil not meeting API Group I specifications, having:

i. a saturates level less than 90 weight percent, and ii. one or more suboptimal properties selected from the group consisting of a viscosity index less than 80, a pour point greater than −10 degrees C., and an Oxidator BN of less than 15 hours; and b. blending the lower quality base oil with a Fischer-Tropsch derived distillate fraction having:

i. a Fischer-Tropsch pour point less than −9 degrees C.;

ii. a Fischer-Tropsch viscosity index greater than an amount calculated by the equation: 28×Ln(Kinematic Viscosity at 100° C.)+80;

iii. a Fischer-Tropsch Oxidator BN of greater than 20 hours;

iv. a kinematic viscosity at 100° C. between about 1.5 $mm^2/s$ and about 5.5 $mm^2/s$; and c. isolating the API Group I base oil;

wherein the API Group I base oil has a viscosity index greater than 95, a pour point less than −7 degrees C., and an Oxidator BN of greater than 9.5 hours.

2. The process of claim 1, wherein the lower quality base oil is petroleum derived.

3. The process of claim 1, wherein the Fischer-Tropsch derived distillate fraction has between 90 and 99 wt % paraffinic carbon and between 2 and 10 wt % naphthenic carbon.

4. The process of claim 1, wherein the Fischer-Tropsch derived distillate fraction has greater than 10 wt % total molecules with cycloparaffinic functionality and a ratio of molecules with monocycloparaffinic functionality to molecules with multicycloparaffinic functionality greater than 3.

5. The process of claim 1, wherein the Fischer-Tropsch derived distillate fraction has greater than 99 wt % saturates by HPLC.

6. The process of claim 1, wherein the Fischer-Tropsch derived distillate fraction has a Fischer-Tropsch viscosity index greater than an amount calculated by the equation: 28×Ln(Kinematic Viscosity at 100° C.)+90.

7. The process of claim 1, wherein the API Group I base oil has a Noack volatility less than an amount calculated by the equation: 2000×(Kinematic Viscosity at 100° C.)$^{-2.7}$.

8. The process of claim 1, wherein the lower quality base oil has a higher kinematic viscosity than the Fischer-Tropsch derived distillate fraction.

9. A process for improving the lubricating properties of a lower quality base oil not meeting API Group I specifications, that is characterized by:

a. a saturates level less than 70 weight percent, b. a viscosity index less than 70, and c. an Oxidator BN of less than 6 hours;

the process comprising: blending with said lower quality base oil a Fischer-Tropsch derived distillate fraction having a kinematic viscosity at 100° C. between about 1.5 mm$^2$/s and about 5.5 mm$^2$/s; wherein an API Group I base oil is produced.

10. The process of claim 1 or claim 9, wherein the lower quality base oil is petroleum derived.

11. The process of claim 1 or claim 9, wherein the API Group I base oil comprises at least 10 wt %, based on the total composition, of said lower quality base oil, and between 10 and 50 wt %, based on the total composition, of said Fischer-Tropsch derived distillate fraction.

12. The process of claim 1 or claim 9, additionally including the step of mixing the API Group I base oil with at least one additive to make a finished lubricant.

13. The process of claim 1 or claim 9, wherein the lower quality base oil is made in a solvent plant by a solvent dewaxing process.

14. A process for operating a base oil plant, comprising:

a. selecting a refinery operating condition to produce a lower quality base oil not meeting API Group I specifications, that is characterized by:

i. a saturates level less than 70 weight percent, ii. a viscosity index less than 70, and iii. an Oxidator BN of less than 6 hours;

b. blending the lower quality base oil with a second base oil having a kinematic viscosity at 100° C. between about 1.5 mm$^2$/s and about 5.5 mm$^2$/s to make a blended base oil meeting API Group I specifications.

15. The process of claim 14, wherein the lower quality base oil is petroleum derived.

16. The process of claim 14, wherein the second base oil is Fischer-Tropsch derived.

17. The process of claim 14, wherein the second base oil has a viscosity index greater than an amount defined by the equation: 28×Ln(Kinematic Viscosity at 100° C.)+80.

18. The process of claim 17, wherein the second base oil has a viscosity index greater than an amount defined by the following equation: 28×Ln(Kinematic Viscosity at 100° C.)+90.

19. The process of claim 14, wherein the refinery operating condition comprises solvent dewaxing.

20. The process of claim 14, wherein the viscosity index is less than 50.

21. The process of claim 14, wherein the Oxidator BN is less than 4 hours.

22. The process of claim 14, wherein the saturates level is less than 60 weight percent.

23. The process of claim 14, wherein the blended base oil is selected from the group of LN grade, MN grade, and HN grade.

24. The process of claim 14, wherein the blended base oil has a Noack volatility less than an amount calculated by the equation: 2000×(Kinematic Viscosity at 100° C.)$^{-2.7}$.

25. The process of claim 14, wherein the blended base oil has a viscosity index greater than 100.

26. The process of claim 14, wherein the second base oil has a lower kinematic viscosity than the lower quality base oil.

27. The process of claim 26, wherein the lower quality base oil is a MN or a HN grade.

28. A process for producing an API Group I base oil, consisting essentially of: (a) selecting a lower quality base oil not meeting API Group I specifications, that is characterized by a saturates level less than 70 weight percent, a viscosity index less than 70, and an Oxidator BN of less than 6 hours; and (b) blending the lower quality base oil with a Group II base oil and a Fischer-Tropsch derived base oil having a kinematic viscosity at 100° C. between about 1.5 mm$^2$/s and about 5.5 mm$^2$/s to make an API Group I base oil.

29. The process of claim 1, claim 9, claim 14, or claim 28, wherein the API Group I base oil has a blend kinematic viscosity at 100° C. between about 3.5 mm$^2$/s and about 15 mm$^2$/s.

30. The process of claim 1, claim 9, claim 14, or claim 28, wherein the lower quality base oil not meeting API Group I specifications has a negative viscosity index.

31. A process for producing an API Group I base oil, comprising:

a. obtaining a lower quality base oil not meeting API Group I specifications, having:

i. a saturates level less than 90 weight percent, and ii. one or more suboptimal properties selected from the group consisting of a viscosity index less than 80, a pour point greater than −10 degrees C., and an Oxidator BN of less than 15 hours; and b. blending the lower quality base oil with a Fischer-Tropsch derived distillate fraction having:

i. a Fischer-Tropsch pour point less than −9 degrees C.;

ii. a Fischer-Tropsch viscosity index greater than an amount calculated by the equation: 28×Ln(Kinematic Viscosity at 100° C.)+80;

iii. a Fischer-Tropsch Oxidator BN of greater than 20 hours;

iv. a kinematic viscosity at 100° C. between about 1.5 mm$^2$/s and about 7.93 mm$^2$/S; and c. isolating the API Group I base oil;

wherein the API Group I base oil has a viscosity index greater than 95, a pour point less than −7 degrees C., and an Oxidator BN of greater than 9.5 hours; and wherein the API Group I base oil comprises at least 10 wt % up to 35 wt % of said lower quality base oil.

32. The process of claim 31, wherein the Fischer-Tropsch derived distillate fraction has a kinematic viscosity at 100° C. between about 1.5 mm$^2$/s and about 5.5 mm$^2$/s.

33. The process of claim 31, wherein the lower quality base oil has a kinematic viscosity at 100° C. from 3.436 mm$^2$/s to 16.94 mm$^2$/s.

34. A process for improving the lubricating properties of a lower quality base oil not meeting API Group I specifications, that is characterized by:

a. a saturates level less than 70 weight percent, b. a viscosity index less than 70, and c. an Oxidator BN of less than 6 hours;

the process comprising: blending with said lower quality base oil a Fischer-Tropsch derived distillate fraction having a kinematic viscosity at 100° C. between about 1.5 mm$^2$/s and about 7.93 mm$^2$/s; wherein an API Group I base oil is produced; and wherein the API Group I base oil comprises at least 10 wt % up to 35 wt % of said lower quality base oil.

35. The process of claim 34, wherein the Fischer-Tropsch derived distillate fraction has a kinematic viscosity at 100° C. between about 1.5 $mm^2/s$ and about 5.5 $mm^2/s$.

36. The process of claim 34, wherein said lower quality base oil has a kinematic viscosity at 100° C. from 3.436 $mm^2/s$ to 16.94 $mm^2/s$.

37. A process for operating a base oil plant, comprising:

a. selecting a refinery operating condition to produce a lower quality base oil not meeting API Group I specifications, that is characterized by:
   i. a saturates level less than 70 weight percent,
   ii. a viscosity index less than 70, and
   iii. an Oxidator BN of less than 6 hours;

b. blending the lower quality base oil with a second base oil having a kinematic viscosity at 100° C. between about 1.5 $mm^2/s$ and 7.93 $mm^2/s$ to make a blended base oil meeting API Group I specifications and wherein the API Group I base oil comprises at least 10 wt % up to 35 wt % of said lower quality base oil.

38. The process of claim 37, wherein the second base oil has a kinematic viscosity at 100° C. between about 1.5 $mm^2/s$ and about 5.5 $mm^2/s$.

39. The process of claim 37, wherein the lower quality base oil has a kinematic viscosity at 100° C. from 3.436 $mm^2/s$ to 16.94 $mm^2/s$.

* * * * *